United States Patent [19]

Motohashi et al.

[11] Patent Number: 4,796,678

[45] Date of Patent: Jan. 10, 1989

[54] LIQUID DELIVERY APPARATUS

[75] Inventors: Toshiaki Motohashi; Yasushi Saisu, both of Tokyo, Japan

[73] Assignee: Tokyo Tatsuno Co., Ltd., Tokyo, Japan

[21] Appl. No.: 120,436

[22] Filed: Nov. 13, 1987

[30] Foreign Application Priority Data

Nov. 13, 1986 [JP] Japan ..... 61-270338

[51] Int. Cl.[4] ..... B65B 3/26

[52] U.S. Cl. ..... 141/206; 141/208; 141/198

[58] Field of Search ..... 141/206–229, 141/198; 251/174; 137/508; 222/511, 473, 518, 9 A; 239/571, 572

[56] References Cited

U.S. PATENT DOCUMENTS

| | | | |
|---|---|---|---|
| 1,152,604 | 9/1915 | Coll | 137/508 |
| 1,948,628 | 11/1929 | Penick et al. | 251/359 |
| 2,866,477 | 12/1958 | Bredtschneider et al. | 251/174 |
| 3,638,689 | 2/1972 | Eklund | 141/208 |
| 3,688,813 | 9/1972 | Mayer | 141/206 |
| 3,905,524 | 9/1975 | Tatsuno | 137/615 |
| 4,343,336 | 8/1982 | Trygg | 141/206 |
| 4,522,237 | 6/1985 | Endo et al. | 141/95 |

FOREIGN PATENT DOCUMENTS

| | | |
|---|---|---|
| 1033074 | 6/1958 | Fed. Rep. of Germany . |
| 3429026 | 2/1986 | Fed. Rep. of Germany . |

*Primary Examiner*—Henry J. Recla
*Assistant Examiner*—Edward C. Donovan
*Attorney, Agent, or Firm*—Sughrue, Mion, Zinn, Macpeak & Seas

[57] ABSTRACT

An apparatus for topping off a fuel tank which is necessary for full tank delivery after false fuel level detection caused by fuel bubbles or splashes. This is made possible by making a spring biased valve sent for a main valve longitudinally movable and providing control means and a mechanism so that despite a trigger being in the actuated position the valve is opened when bubbles or splashes disappear.

8 Claims, 9 Drawing Sheets

LIQUID DELIVERY APPARATUS

TECHNICAL FIELD OF THE INVENTION AND RELATED ART

This invention relates to an apparatus for dispensing liquid such as fuel for a vehicle such as an automobile, and more particularly to a fuel delivery nozzle to be used in said apparatus, which essentially comprises an elongated barrel portion, a hollow body portion having a valve means arranged therein and normally closed, and trigger means to be manually actuated so as to open said valve means for dispensing through said barrel portion.

In gasoline stations, fuel is generally supplied so as to fully fill a tank of the automobile. Such dispensation must be carefully made in order to avoid possible overflow of fuel out of a top open end of a filler pipe connected to the vehicle tank.

It has been proposed and actually used for a long time to provide various types of delivery nozzles adapted to automatically close the valve means when a fuel level rises up close to the tip end of the delivery nozzle which is inserted in the filler pipe, in order to aviod said fluid overflow.

One type of such delivery nozzles has a slender air passage extending from the tip end, where one end thereof is opened, to a negative pressure generating portion which is communicated with a chamber formed in the body portion so that when said one end of the air passage is closed by fuel rising up in the filler pipe, a negative pressure is generated in said chamber so as to actuate a mechanism for automatically closing the valve means, which is disclosed for instance in U.S. Pat. No. 3,905,524 and explained later in more detail.

This mechanism is still unsatisfactory, however, since there is a problem of the so-called surging which inevitably causes fuel splashes and bubbles on and above the fuel level, whereby the open end of the air passage is closed so as to automatically close the valve means and cause early cut-off of fuel supply. In order to fully fill the tank with fuel, the trigger must be reactuated. It is not always so easy to avoid such surging problem even by the skilled operator, since sizes, shapes and mount angles of the filler pipes are varied from one vehicle to another. The operation must often be repeated a few times.

SUMMARY OF THE INVENTION

It is, thus, an object of the invention to provide the fuel delivery apparatus for the fuel delivery nozzle to be used therein of the type referred to above and capable of dispensing fuel to be filled fully in the tank completely automatically by a single operation.

The other objects and advantages of the invention will be appreciated by studying preferred embodiments of the invention illustrated hereafter in reference to accompanying drawings.

DETAILED DESCRIPTION OF PREFERRED EMBODIMENTS

Figure 8:
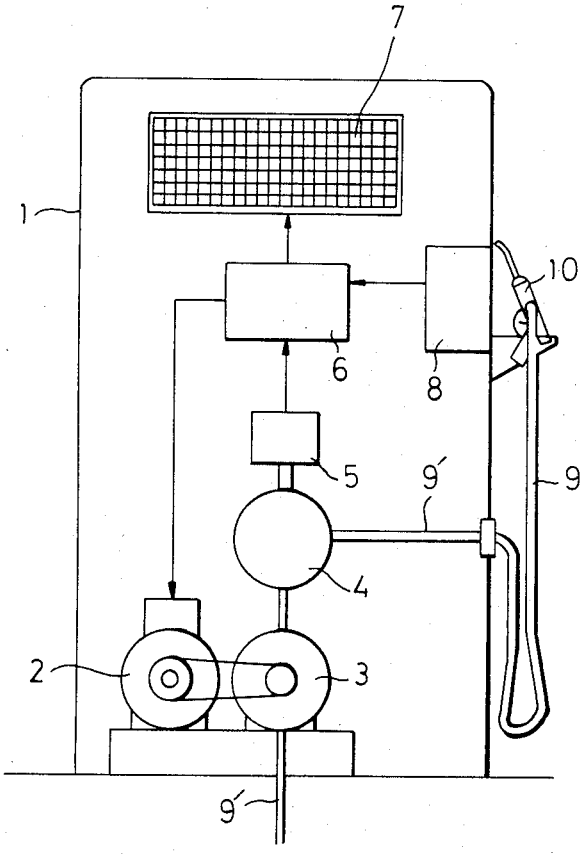
FIG. 8 is a diagrammatic illustration of the apparatus.

In FIG. 8, an apparatus for delivering fuel according to the invention has a casing 1 which contains a motor 2, a pump 3, a flow meter 4, a flow pulse generator 5, control means 6, an indicator 7 and a nozzle switch 8 for delivering a fuel dispensing operation starting signal. A fuel delivery nozzle 10 is connected through a flexible hose 9 with the free end of a conduit 9' extending through the flow meter and the pump 3 down to an under-ground fuel reservoir not shown.

When the delivery nozzle 10 hung on the wall of the casing wall 1 is taken off for starting fuel delivery, the nozzle switch 8 is actuated to energize the motor 2, through the control means 6, and consequently drive the pump 3 for feeding fuel to the nozzle 10 so that when valve means therein is actuated fuel may be delivered to the vehicle. The flow meter counts the amount of fuel flowing therethrough and the flow pulse generator 5 generates corresponding pulse signals, which are processed by the control means 6 for indicating the supplied fuel volume on the indicator 7.

Figure 1:
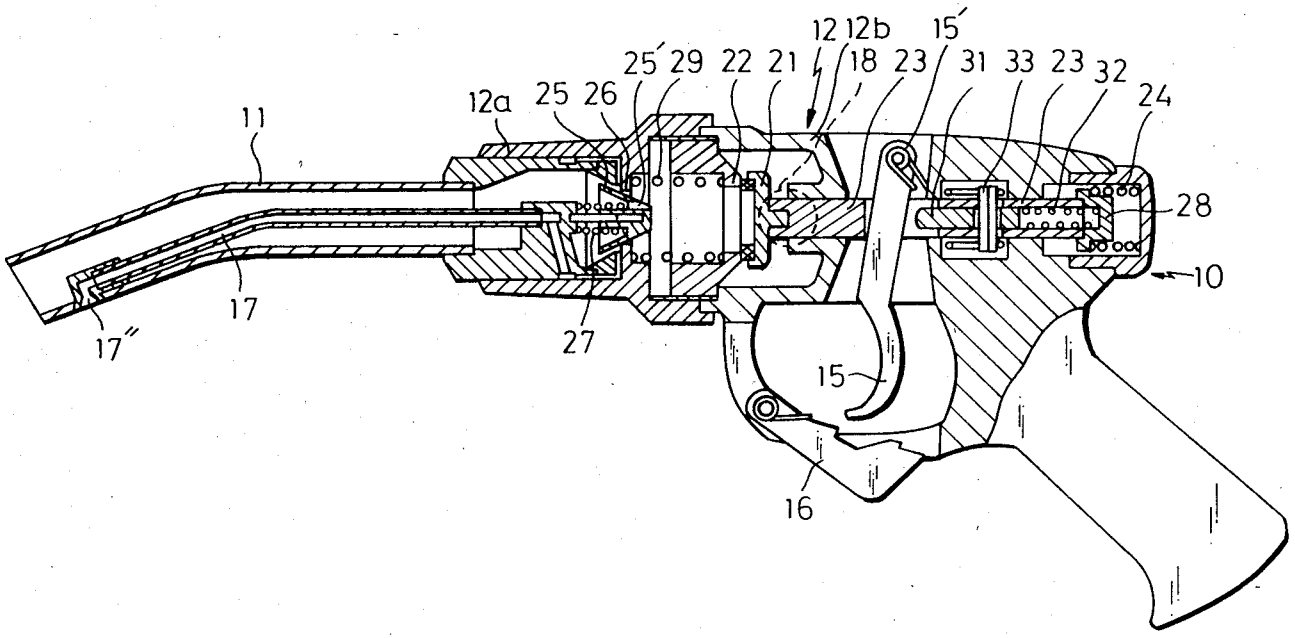
FIG. 1 is a side elevation partly in section of the fuel delivery nozzle to be used in the apparatus according to the invention.
Figure 2:
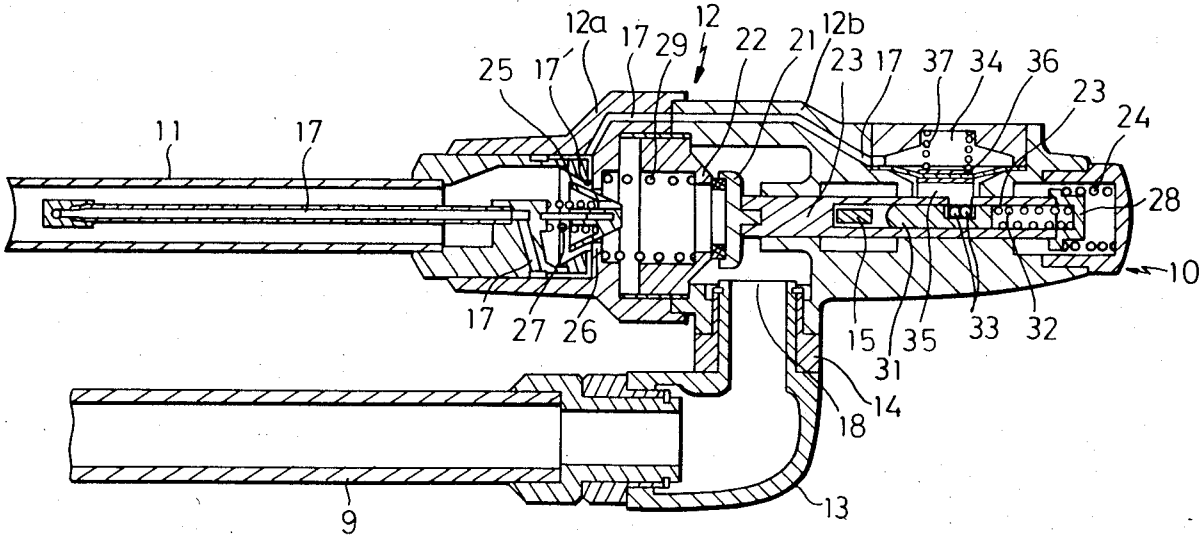
FIG. 2 is a sectional plan view of the above.

Now in reference to FIGS. 1 and 2, the fuel delivery nozzle represented generally by 10 has a barrel portion 11, a hollow body portion 12 which is preferably formed from two portions **12*a* and 12*b* so as to be liquid tightly connected after mounting valves, springs and the like to be referred to hereafter in said two portions 12*a* and 12*b*, an elbow 13 (see FIG. 2) transversely protruded via a swivel joint 14 from the body portion 12 to which the flexible hose 9 is connected, a trigger 15 mounted at the body portion 12 so as to be manually actuated to open valve means to be explained later, a latch 16 having a few steps each to be engaged with the free end of the trigger for keeping the valve means in the open position in different open degrees, and a slender air passage 17 extending from the tip end 17'', where one end thereof is opened, of the barrel portion 11 to a chamber 34 formed in the body portion 12. The elbow 13 opens at the other end as an inlet 18, which is shown in FIG. 1 by phantom lines, so as to feed fuel from the hose 9 into the body portion 12**.

There is provided in the body portion 12 a main valve 21 abutting on a valve seat 22 so as to prevent fuel to be pumped up through the inlet port 18 from flowing into the barrel portion 11. The main valve 21 has an extended valve rod 23 to be fixed therewith, the tail end of which is urged by a coiled spring 24 so as to push the main valve 21 toward the valve seat 22. There is provided downstream from the main valve 21 further a check valve 25 which normally abuts on a valve seat 26 by means of a coiled spring 27.

There is provided, behind the trigger 15 normally kept at the position illustrated in FIGS. 1 and 2 by a coiled spring 15', a bar 31 which is adapted to be slidingly movable relative to the valve rod 23 in and along a longitudinal groove formed therein but normally kept at the illustrated position by a coiled spring 32 loaded between the rear end of said bar 31 and a cap 28 mounted at the rear end of said groove and consequently of said valve rod 23. The bar 31 is longitudinally movable together with the valve rod 23 as a united body by means of a pin or pins 33 extended across the both and fitted in transverse recesses formed therein. Thus, when actuating the trigger 15, the bar 31 engaged with the trigger 15 and consequently the valve rod 23 is pushed rearward against the force of the coiled spring 24 to open the main valve 21. Thus fuel now flows under pressure to push the check valve 25 against the force of the concerned spring 27 out of the barrel portion 11.

In the body portion 12 and in the vicinity of said pins 33, there is formed the chamber which is divided into two 34, 35 by a diaphragm 36 which is normally kept at the illustrated position by a coiled spring 37 mounted in the chamber 34, in which the air passage 17 is opened. It is not always clear from the drawings but the diaphragm 36 is mechanically connected with the pins 33 so that when the diaphragm 36 is pulled toward the chamber 34 to be convex therein against the force of the spring 37 by differential air pressure formed between the two chambers to be explained later the pins 33 may be pulled thereby out of the recesses formed in the bar 31 so as to disengage the unity thereof.

When fuel flows around the tapered check valve 25, there is caused negative pressure in a branched air passage 17' opening there according to the Venturi effect so that the open end 17" of the air passage 17 sucks air at the tip end of the barrel portion 11, but there is caused no differential air pressure between the chambers 34 and 35. When said open end 17" of the slender air passage 17 is closed by fuel or splashes or bubbles thereof, negative pressure is caused in the chamber 34 where the other end of the air passage 17 is opened so that the diapharagm 36 is pulled to be convex in said chamber so as to pull the pins 33 out of the cross recesses of the bar 31, which are disengaged with each other as referred to above. Thus, despite of that the trigger 15 is still being manually actuated or held in position by engagement with any of the steps of the latch 16, the valve rod 23 is moved relative to the bar 31 now disengaged therefrom by the coiled spring 24, and consequently the main valve 21 sits on the valve seat 22 to cut off fuel delivery.

So far as the above is concerned, the construction of the fuel delivery nozzle and arrangement of the concerned elements thereof are substantially same with the disclosure in said U.S. Pat. No. 3,905,524. Such fuel delivery nozzle, however, is not satisfactory since splashes or bubbles of fuel may result delivery cut-off too early when fuel is not yet fully filled as referred to above.

Figure 3:
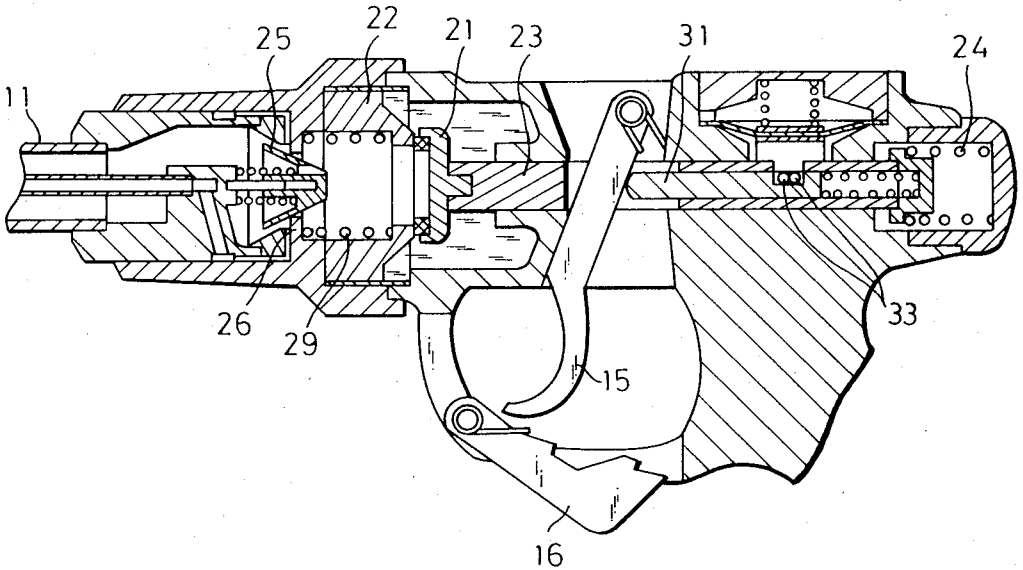
FIG. 3 is a view similar to FIG. 1 but showing arrangement of elements in the body portion, in which positions of a chamber accommodating a diaphragm and related members are changed for convenience of explanation.

According to the invention, the valve seat 22 having a wall exposed in the liquid passage around the main valve is made longitudinally movable and kept in the illustrated position by a strong coiled spring 29, owing to which the full tank delivery is made possible fully automatically. When the valve seat 22 is slidingly moved from the retracted position (left position in the drawings), to which the valve seat 22 is brought by pressure of fuel which is pumped up to be in a chamber just in front of the main valve 21, against the force of the strong coiled spring 29 (see FIGS. 3, 4 and 5) to the normal or advanced position (right position is the drawings), to which the valve seat 22 is brought by said coiled spring 29 when the pump is not operated (see FIGS. 1, 2 and 6), there is caused negative pressure therebehind. It is, thus, preferable to form a through hole 25' in the check valve 25 positioned downstream from the valve seat 22.

Figure 7:
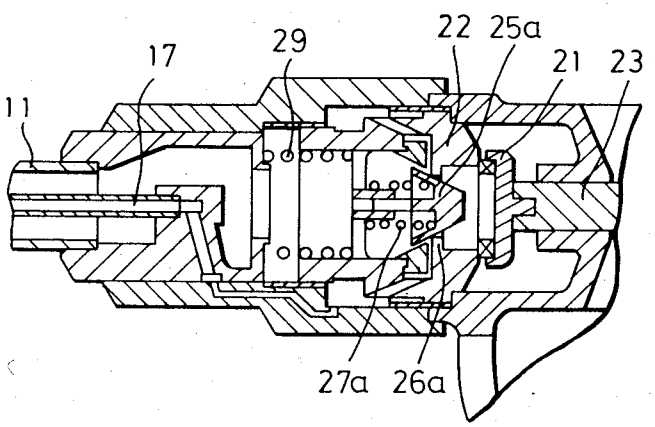
FIG. 7 is a view similar to FIG. 1 but showing another arrangement of the check valve.

In order to avoid forming such through hole or bore 25', the check valve **25*a* may be positioned so as to sit on the valve seat portion 26*a* formed on the valve seat 22 for the main valve 21 as shown in FIG. 7, in which the closed chamber formed by the valve seat 22, the main valve 21 and the check valve 25*a* is shifted without changing its volume when the valve seat 22 on which the main valve 21** sits is moved toward right, in contrast with that mentioned in the preceding embodiment.

Figure 9:
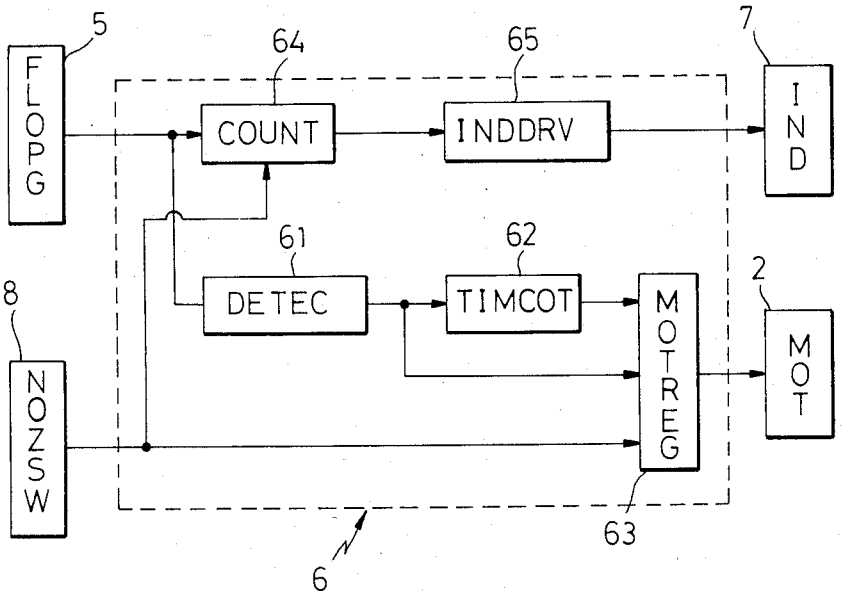
FIG. 9 is a block diagram of the control means of the apparatus.

In reference to FIG. 9, the control means 6 circled with phantom lines comprises detector means 61 for detecting absence of the pulses signal from the fuel flow pulse generator 5 so as to give the corresponding signal to time counting means 62 and motor regulator means 63. Said time counting means 62 gives the corresponding signal in reply to said signal from the detector means 61 to the regulator means 63 after the lapse of previously set time for driving the pump motor 2. Said motor regulator means 63 is adapted to drive the pump motor 2 in reply to the fuel dispensing operation starting signal from the nozzle switch 8, deenergize the pump motor 2 in reply to the signal from the detector means 61 and be turned to refuse receiving any further signals from said time counting means 62 after having received a few or several times of signals, whereby it is possible to judge that full tank delivery has been made. Countor means 64 is adapted to integrate flow pulses given by the fuel flow pulse generator 5 to output the integrated numerical figure on the indicator 7 through indicator driving means 65 and be reset in reply to the signal from the nozzle switch 8.

Now in operation, when the nozzle 10 is taken off for fuel dispensation, the motor regulator means 63 detects actuation of the nozzle switch 8 and energizes the pump motor 2 so that fuel is pumped up to flow in a chamber in the body portion 12 which is closed by the main valve 21. Under pressure of fuel the slidingly movable valve seat 22 is moved against the force of the coiled spring 29 from the normal position shown in FIGS. 1 and 2 to the position shown in FIG. 3. The main valve 21 may follow the valve seat 22 by means of the coiled spring 24.

Figure 4:
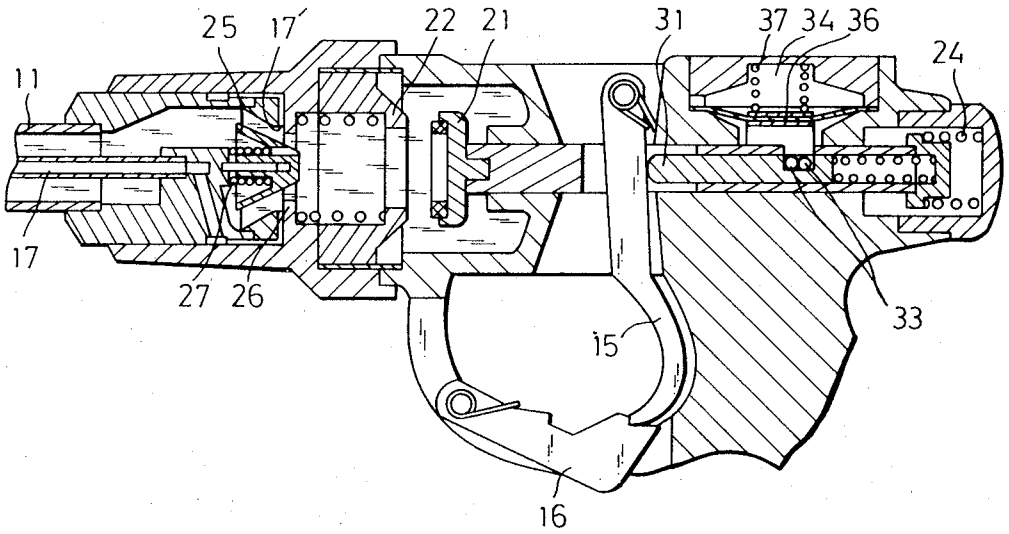
FIG. 4 is a similar view but shown in the state where the trigger is manually actuated.

When the trigger 15 of the delivery nozzle 10 now inserted in the filler pipe of the automobile is manually actuated to be kept in position by engaging with the stepped latch 16, the bar 31 and consequently the valve rod 23 engaged therewith by the pins 33 is moved toward the right side in the drawing against the force of the spring 24 so as to open the main valve 21. Fuel under pressure flows through annular gap now formed between the main valve 21 and the valve seat 22 to push the check valve 25 against the force of the spring 27 and into the filler pipe through the barrel portion 11, as shown in FIG. 4.

In this state there is caused negative pressure in the branched air passage 17' opened in the fuel passage around the check valve 25 owing to be Venturi effect as referred to above so that the air passage 17 opened at the tip end of the barrel portion 11 sucks air. When the level of fuel supplied through the filler pipe to the tank of the automobile gradually rises up and if splashes or bubbles of fuel closes the open end 17" of the air passage 17, the other end of the air passage 17 opened in the chamber 34 is made to be of negative pressure so as to pull the diaphragm 36 to be convex toward said chamber against the force of the spring 37, whereby the pins 33 are raised up together with said diaphragm movement or deformation from the recesses formed across the bar 21 so that the unity thereof is disengaged as shown in FIG. 5.

Figure 5:
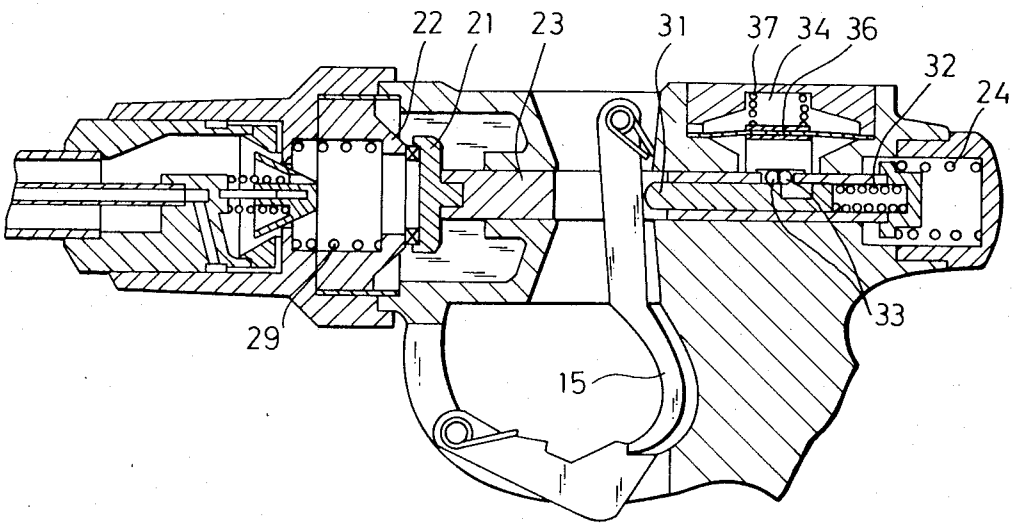
FIGS. 5 and 6 are similar views but shown in the states where concerned elements are actuated to be in different positions.

Thus, despite of that the trigger 15 is still in the actuated position and consequently the bar 31 is pushed toward the right in the drawing against the force of the spring 32, the valve rod 23 and consequently the main valve 21 is urged toward the valve seat 22 by means of the spring 24 to prevent fuel from flowing through the gap therebetween as shown in FIG. 5.

The detector means 61 in FIG. 9 detects absence of fuel flow pulses signal so as to actuate the time counting means 62 and give the signal to the motor regulator means 63 so as to deenergize the pump motor 2. Thus, fuel in the chamber closed by the main valve 21 now sitting on the valve seat 22 is freed from pressure so that the slidingly movable valve seat 22 is urged by the strong spring 29 to be in the normal position shown in FIG. 6, whereby the main valve 21 and consequently the valve rod 23 is pushed toward the right in the drawing against the force of the weaker spring 24. Thus, the transverse recesses formed across the valve rod 23 and the bar 31 is in alignment so that the pins 33, which are urged by the spring 37 through the diaphragm 36 now returned to the normal position and mechanically connected with the pins 33, are pushed into said recesses, whereby the unity of the valve rod 23 and the bar 31 in the longitudinal direction is recovered, as shown in FIG. 6.

After the lapse of a predetermined and previously set time generally necessary for fuel bubbles to disappear, e.g. a few seconds for gasoline, the time counting means 62 outputs the signal, in reply to which the motor regulator means 63 reenergizes the pump motor 2, whereby the state of FIG. 4 is restored so as to start fuel dispensation again.

Figure 6:
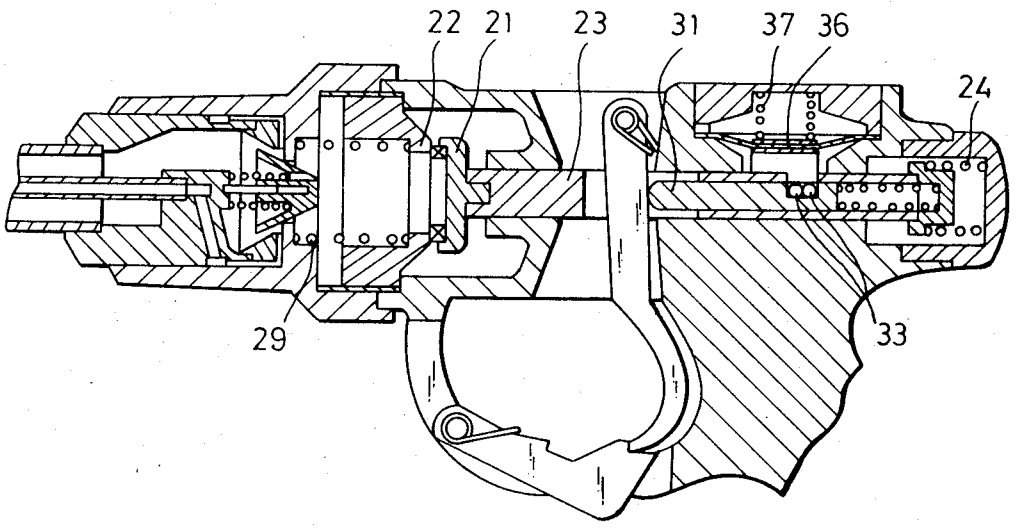

When the open end 17'' of the air passage 17 is closed with fuel splashes or bubbles, the states shown in FIGS. 5 and 6 are restored. When such operation is repeated a few or several times which must be predetermined and set in advance, the motor regulator means 63 deenergizes the pump motor 2 without affection by the further signals from the time counting means 62. The fuel delivery is terminated in the state shown in FIG. 6. Lastly, the trigger 15 is disengaged from the latch 16 and then the nozzle 10 returned to the state shown in FIG. 1 is hung on the casing 1. Thus the fuel delivery operation is finished.

In brief of the above, the main fuel dispensation is carried out by starting from the first stage where the slidingly movable valve seat 23 is in the advanced position urged by the strong spring 29 on which the main valve 21 sits of which valve rod 22 is engaged with the bar 31 as a united body to be longitudinally movable together (FIGS. 1 and 2), through the second stage where the pump 3 is driven so that the valve seat 22 is urged by fuel under pressure to the retracted position against the force of the strong spring 29 to which the main valve 21 follows by means of the spring 24 (FIG. 3), through the third stage where the trigger 15 is actuated and latched so that the valve rod 23 as well as the bar 31 is pushed thereby against the force of the spring 24 for opening fuel passage (FIG. 4), through the fourth stage where upon closing of the open tip end 17'' of the air passage 17 by fuel flushes or bubbles, the valve rod 23 is disengaged from the bar 31 so as to sit on the valve seat 22 by means of the spring 24 for closing fuel passage (FIG. 5), and finishing with the fifth stage where the pump 3 is momentarily stopped so that the valve seat 22 is brought in the advanced position again so as to engage the valve rod 23 with the bar 31 by means of the latch pins 33 (FIG. 6). Thereafter the third, fourth and fifth stages are repeated for the additional dispensation so as to complete the full tank dispensation.

In the embodiment referred to above, the additional dispensation is carried out by the same discharge volume with that in the main dispensation, but it is of course possible and usually preferable to squeeze the volume e.g. to 20 l/min. for the first additional dispensation, 5 l/min. for the second in contrast with 45 l/min. for the main dispensation.

In the embodiment referred to above, the pump motor 2 is deenergized in reply to the signal from the detector 61, but it is possible to provide a control valve in the way of fuel passage from the pump 3 to the delivery nozzle 10 so as to stop supply of fuel.

What is claimed is:

1. Apparatus for liquid delivery comprising a barrel portion having an open free end;

a hollow body portion integrally fixed thereto and having an inlet to form a liquid passage extending therefrom through the barrel portion to said open free end;

a trigger mounted at said body portion so as to be manually actuated;

a main valve arranged downstream from said inlet in the liquid passage in the body portion and having a valve rod to be longitudinally movable together;

a valve set arranged so as to face said main valve and having a wall exposed in the liquid passage around said main valve;

first spring means for urging said main valve toward said valve seat for normally closing the liquid passage;

an extended bar arranged so as to be longitudinally moved by the actuated trigger;

second spring means for urging said bar toward said trigger;

means for disengageably engaging said bar with said valve rod so as to be longitudinally movable together;

and means for detecting liquid level rising up close to the open free end of said barrel portion and adapted to actuate said engaging means so as to disengage said bar from said valve rod when detecting liquid inclusive of bubbles and splashes thereof; in which said valve seat is made slidingly movable toward said main valve by third spring means and apart therefrom by pressure force of liquid pumped up through said inlet in the liquid passage to be just in front of said main valve and the exposed wall of said valve seat against the force of said third spring, to which said main valve follows by the force of said first spring means;

whereby when actuating the trigger, the bar and consequently the valve rod engaged therewith is longitudinally moved against the force of said first spring means so as to open the liquid passage;

when said detecting means detects liquid splashes and bubbles, said valve rod is disengaged from said bar so that said valve rod is longitudinally moved by said first spring means despite of that the trigger is still actuated and the main valve closes the liquid passage; and, when liquid is freed from pressure, the main valve seat is slidingly moved toward the main valve by the force of said third spring means so that said detecting means now detecting no splashes and bubbles actuates said engaging means so as to engage said bar with said valve rod again.

2. The apparatus according to claim 1, which comprises a pump for supplying liquid into said body portion through said inlet, a motor for driving said pump, and control means comprising detector means for detecting liquid supply stop, counting means for counting time and motor regulator means, said detector means being adapted to give a timer signal to said time counting means and a stopping signal to said motor regulator means when detecting absence of liquid supply, said time counting means being adapted to give a signal to said motor regulating means for driving the pump motor in reply to said signal from the liquid supply stop detector means after the lapse of time set in advance, said motor regulator means being adapted to energize the motor upon receiving both a delivery starting signal from a nozzle switch and a signal from the time counting means, deenergize the motor upon receiving a signal from the detector means and deenergize the motor for definitely finishing liquid delivery after repetition of a plurality of times set in advance.

3. The apparatus according to claim 1, in which said means for disengageably engaging said bar with said valve rod comprises an air passage extending from the tip end of said barrel portion to a chamber formed in the body portion, which is divided into two by a diaphragm into one of which said air passage is opened, said diaphragm having engaging means disengageably engaging said bar with said valve rod, said air passage being branched to open in the fluid passage in the vicinity of a check valve so as to generate negative pressure therein, whereby when the free end of said air passage is closed by liquid splashes and bubbles, there is caused negative pressure in said one chamber so that said diaphragm is deformed to be convex therein so as to pick up said engaging means for disengaging said bar from said valve rod.

4. The apparatus according to claim 3, in which said engaging means is in the form of a pin or pins extending across the bar and the valve rod and fit in transverse recesses formed therein.

5. The apparatus according to claim 3, in which said check valve arranged in the liquid passage downstream from said main valve and urged by fourth spring means so as to normally sit on a valve seat therefor, is in the conical form so as to cause negative pressure in the branched passage opened in the vicinity of said check valve.

6. The apparatus according to claim 5, in which said check valve is provided with a through hole for allowing smooth movement of said slidingly movable valve seat.

7. The apparatus according to claim 5, in which the check valve is disposed within the valve seat so as to be movable theretogether and urged by the fourth spring means so as to normally sit on a valve seat formed in the movable valve seat for the main valve.

8. The apparatus according to claim 1, in which said body portion comprises two sections separately formed and fixed with each other after the main valve, the valve seat and the spring are mounted therein.

* * * * *